US006263183B1

(12) United States Patent
Schlueter, Jr. et al.

(10) Patent No.: US 6,263,183 B1
(45) Date of Patent: Jul. 17, 2001

(54) WOVEN BELTS FOR BUSINESS MACHINES

(75) Inventors: Edward L. Schlueter, Jr.; David Battat, both of Rochester; Edward F. Bowler, Jr., Fairport; J. Robert Blaszak, Penfield, all of NY (US)

(73) Assignee: Xerox Corporation, Stamford ( * ) Notice: Subject to any disclaimer, the term of this patent is extended or adjusted under 35 U.S.C. 154(b) by 0 days.

(21) Appl. No.: 09/411,271

(22) Filed: Oct. 4, 1999

(51) Int. Cl.[7] ..... G03G 15/20; G03G 15/16
(52) U.S. Cl. ..... 399/329; 399/307
(58) Field of Search ..... 399/307, 329, 399/330; 219/216; 428/58, 59, 102

(56) References Cited

U.S. PATENT DOCUMENTS

| | | | | |
|---|---|---|---|---|
| 3,670,504 | * | 6/1972 | Hayes et al. | 405/32 |
| 3,889,305 | * | 6/1975 | Goldberg | 5/698 |
| 5,012,291 | * | 4/1991 | Buchan et al. | 399/147 |
| 5,100,713 | * | 3/1992 | Homma et al. | 442/102 |
| 5,168,005 | * | 12/1992 | Keating et al. | 442/205 |
| 5,503,887 | * | 4/1996 | Diaz et al. | 428/58 |
| 5,918,099 | * | 6/1999 | Schlueter, Jr. et al. | 399/333 |
| 5,999,787 | * | 4/1999 | Finsterwalder et al. | 399/329 |

OTHER PUBLICATIONS

U.S. application No. 08/721,418, Lynd et al, filed Sep. 26, 1996, (Attorney's Docket No. D/96154) entitled "Process and Apparatus for Producing an Endless Seamed Belt".

U.S. application No. 08/936,696, Limburg et al., filed Sep. 24, 1997, (Attorney's Docket No. D/96632) entitled "Invisible Seam Electrostatographic Belt".

U.S. application No. 09/004,636, Hammond et al., filed Jan. 8, 1998, (Attorney's Docket No. D/97525) entitled Process and Apparatus for Producing an Endless Seamed Belt.

* cited by examiner

*Primary Examiner*—Quana M. Grainger
(74) *Attorney, Agent, or Firm*—John M. Kelly; David E. Henn

(57) ABSTRACT

Multiple layer fuser belts having a woven fabric layer and a high conformability, low surface energy elastic layer. The fabric layer is formed from high modulus, high temperature fibers that are woven together at acute angles to the circumference of the belt fibers. The fabric layer forms a substrate with preferential stretching along the circumference of the fuser belt. The elastic layer is bonded to the fabric layer and is made from a highly conformable, low durometer material having a low surface tension. When the fuser belt is partially wrapped around a driven roller so as to form a nip with a pressure roller the fuser belt stretches in the direction of belt motion. As the fuser belt passes through the nip the fuser belt contracts, releasing surface tension and thus reduces sticking between the fuser belt and fused toner.

20 Claims, 5 Drawing Sheets

FIG. 3
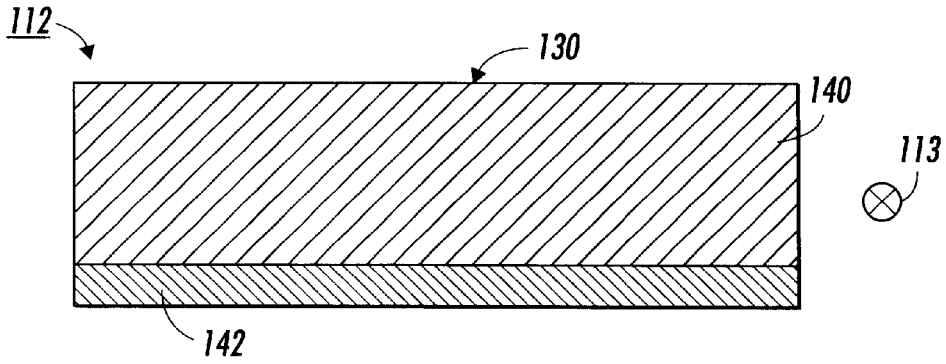
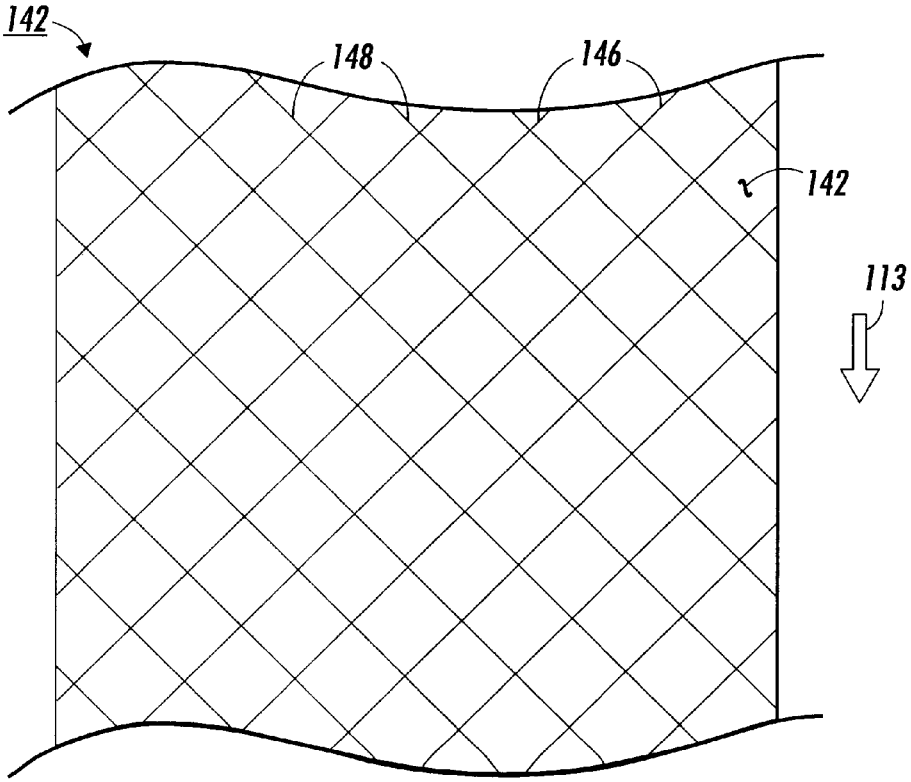
FIG. 4

WOVEN BELTS FOR BUSINESS MACHINES

FIELD OF THE INVENTION

This invention relates to fuser belts. More particularly it relates to user belts having strain release provided by a fabric layer woven to provide a directionally preferred stretch.

BACKGROUND OF THE INVENTION

Electrophotographic marking is a well known and commonly used method of copying or printing original documents. Electrophotographic marking is performed by exposing a light image representation of a desired document onto a substantially uniformly charged photoreceptor. In response to that light image the photoreceptor discharges, creating an electrostatic latent image of the desired document on the photoreceptor's surface. Toner particles are then deposited onto the latent image to form a toner image. That toner image is then transferred from the photoreceptor onto a receiving substrate such as a sheet of paper. The transferred toner image is then fused to the receiving substrate. The surface of the photoreceptor is then cleaned of residual developing material and recharged in preparation for the production of another image.

Of the various electrophotographic printing processes mentioned above, this invention relates most generally to fusing the toner with the receiving substrate. While fusing has been performed in several ways, the most common method is to pass a toner-bearing substrate through a heated pressure nip. The combination of heat and pressure fuses the toner with the substrate. The heated pressure nip is often formed using a heated fuser roller, a pressure roller, and a conformable fuser belt that overlaps the fuser roller and that is disposed between the fuser roller and the pressure roller. When the toner-bearing receiving substrate passes between the fuser belt and the pressure roller, with the toner contacting the fuser belt, the toner is fused with the receiving substrate.

While heated pressure nips are successful, they have problems. One common problem is that the fused toner and the receiving substrate tend to stick to the fuser belt. A prior art approach to addressing the sticking problem is to use a small diameter fuser roller and/or a sharp fuser belt turn. The resulting sharp turn tends to separate the fused toner-substrate from the fusing system. Another approach is to coat the surface of the fuser belt with a release agent, thereby reducing the fuser belt's surface tension and reducing sticking. Yet another method of addressing the sticking problem is to use an elastic belt. Unfortunately, these methods are insufficient in some applications. Therefore, a new way of addressing the sticking problem would be beneficial.

SUMMARY OF THE INVENTION

The principles of the present invention provide for fuser belts with improved release characteristics. A fuser belt according to the principles of the present invention has at least two layers, a substrate layer comprised of a woven fabric that provides preferential stretching along the circumference of the fuser belt and of an elastic layer. This woven fabric can be comprised of high temperature resistant material that can be made electrically, thermally and magnetically conductive. A beneficial material goes by the trade name Nomex. The substrate layer is beneficially comprised of high modulus, high temperature fibers that are woven together at acute angles to the circumference of the belt. The elastic layer is beneficially comprised of a highly conformable, low durometer material having a low surface tension, for example, a silicone. The elastic layer material should survive the high fusing temperature. Suitable elastic layer materials include silicone, fluoropolymer, or silicone-flouropolymer hybrids.

The principles of the present invention further provide for printing machines with fusers belts that have improved release characteristics. A printing machine according to the principles of the present invention includes a photoreceptor having a photoconductive surface, a charging station for charging that photoconductive surface to a predetermined potential, at least one exposure station for exposing the photoconductive surface to produce an electrostatic latent image on the photoconductive surface, at least one developing station for depositing a toner layer on the latent image, and a fuser that fuses the toner layer onto a receiving substrate. The fuser includes a fuser belt that is comprised of at least two layers, a substrate layer comprised of a woven fabric that provides preferential stretching along the circumference of the fuser belt and of an elastic contact layer. The substrate layer is beneficially comprised of high modulus, high temperature fibers that are woven together at acute angles to the circumference of the belt. The elastic contact layer is beneficially comprised of a highly conformable, low durometer material having a low surface tension, for example, a silicone. The elastic layer material should survive the high fusing temperature.

BRIEF DESCRIPTION OF THE DRAWINGS

Other aspects of the present invention will become apparent as the following description proceeds and upon reference to the drawings, in which:

FIG. 3 illustrates a cutaway view of a fuser belt used in the fuser of FIG. 2;

FIG. 4 illustrates a top-down view of the fuser belt substrate;

DETAILED DESCRIPTION OF THE PREFERRED EMBODIMENTS

Figure 1:
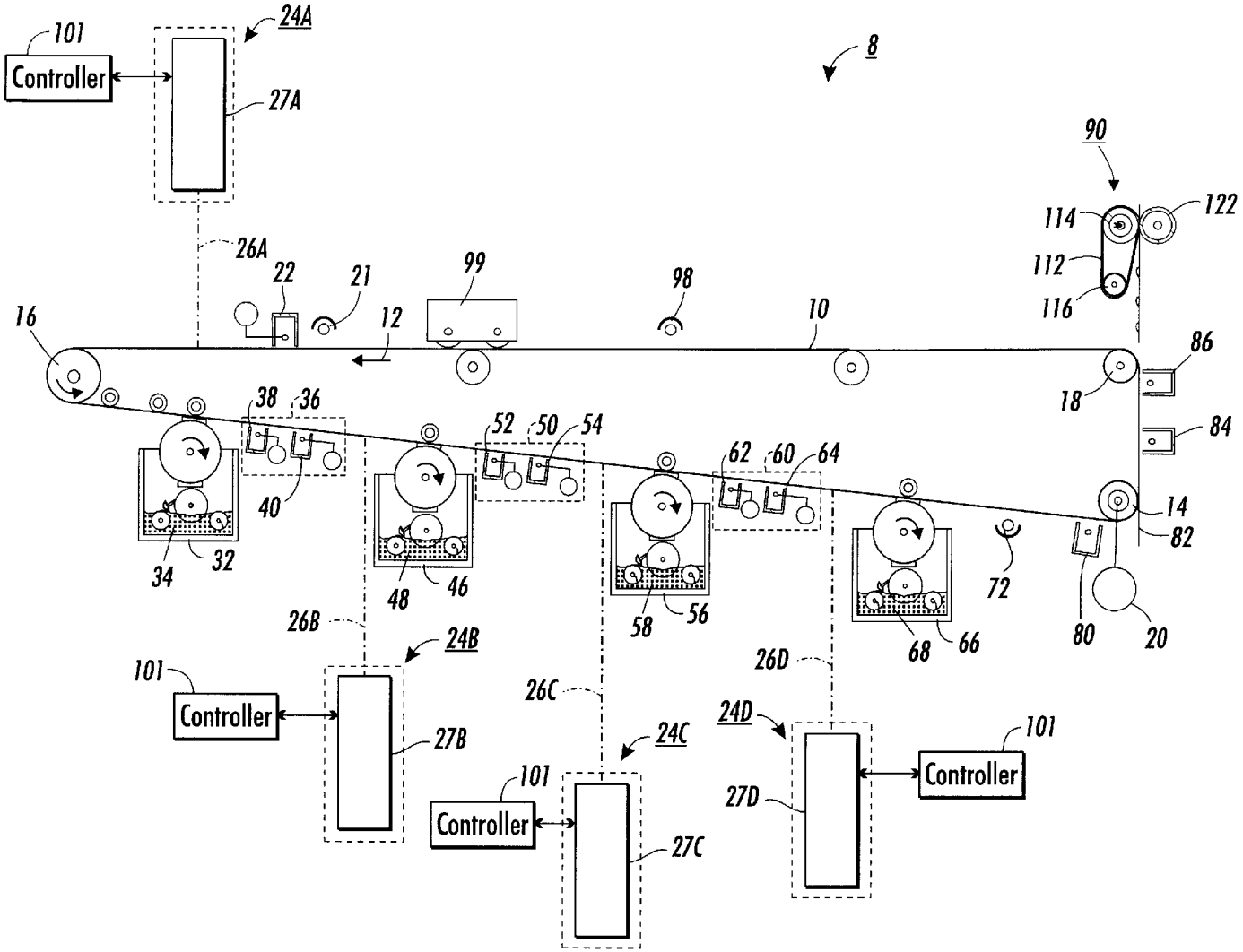
FIG. 1 schematically illustrates an electrophotographic printing machine that incorporates the principles of the present invention.

FIG. 1 illustrates an electrophotographic printing machine 8 that reproduces an original document. Although the principles of the present invention are well suited for use in such reproduction machines, they are also well suited for use in other marking devices. Therefore it should be understood that the present invention is not limited to the particular embodiment illustrated in FIG. 1 or to the particular application shown therein.

The electrophotographic printer 8 is a color electrophotographic, multipass, Recharge-Expose-and-Develop (REaD), Image-on-Image (IOI) printer. That machine includes an Active Matrix (AMAT) photoreceptor belt 10 that travels in the direction 12. Belt travel is brought about by mounting the photoreceptor belt about a driven roller 14 and about tension rollers 16 and 18, and then driving the driven roller 14 with a motor 20.

As the photoreceptor belt travels each part of it passes through each of the subsequently described process stations.

For convenience, a single section of the photoreceptor belt, referred to as the image area, is identified. The image area is that part of the photoreceptor belt which is to receive the various actions and toner layers that produce the final composite color image. While the photoreceptor belt may have numerous image areas, since each image area is processed in the same way a description of the processing of one image area suffices to explain the operation of the printing machine 8.

The imaging process begins with the image area passing a "precharge" erase lamp 21 that illuminates the image area so as to cause any residual charge which might exist on the image area to be discharged. Such erase lamps are common in high quality systems and their use for initial erasure is well known.

As the photoreceptor belt continues its travel the image area passes a charging station comprised of a DC corotron 22. The DC corotron charges the image area in preparation for exposure to create a latent image for black toner. For example, the DC corotron might charge the image area to a substantially uniform potential of about −500 volts. It should be understood that the actual charge placed on the photoreceptor will depend upon many variables, such as the black toner mass that is to be developed and the settings of the black development station (see below).

After passing the charging station the image area advances to an exposure station 24A. At the exposure station the charged image area is exposed to a modulated laser beam 26A from a raster output scanner 27A that raster scans the image area such that an electrostatic latent representation of a black image is produced.

After passing the exposure station 24A the exposed image area with the black latent image passes a black development station 32 that advances black toner 34 onto the image area so as to develop a black toner image. Biasing is such as to effect discharged area development (DAD) of the lower (less negative) of the two voltage levels on the image area. The charged black toner 34 adheres to the exposed areas of the image area, thereby causing the voltage of the illuminated parts of the image area to be about −200 volts. The non-illuminated parts of the image area remain at about −500 volts.

After passing the black development station 32 the image area advances to a recharging station 36 comprised of a DC corotron 38 and an AC scorotron 40. The recharging station 36 recharges the image area and its black toner layer using a technique known as split recharging. Briefly, the DC corotron 38 overcharges the image area to a voltage level greater than that desired when the image area is recharged, while the AC scorotron 40 reduces that voltage level to that which is desired. Split recharging serves to substantially eliminate voltage differences between toned areas and untoned areas and to reduce the level of residual charge remaining on the previously toned areas.

The recharged image area with its black toner layer then advances to an exposure station 24B. There, a laser beam 26B from a raster output scanner 27B exposes the image area to produce an electrostatic latent representation of a yellow image. The now re-exposed image area then advances to a yellow development station 46 that deposits yellow toner 48 onto the image area. After passing the yellow development station the image area advances to a recharging station 50 where a DC scorotron 52 and an AC scorotron 54 split recharge the image area.

An exposure station 24C then exposes the recharged image area. A modulated laser beam 26C from a raster output scanner 27C then exposes the image area to produce an electrostatic latent representation of a magenta image. After passing the magenta exposure station the now re-exposed image area advances to a magenta development station 56 that deposits magenta toner 58 onto the image area. After passing the magenta development station the image area advances another recharging station 60 where a DC corotron 62 and an AC scorotron 64 split recharge the image area.

The recharged image area with its toner layers then advances to an exposure station 24D. There, a laser beam 26D from a raster output scanner 27D exposes the image area to produce an electrostatic latent representation of a cyan image. After passing the exposure station 24D the re-exposed image area advances past a cyan development station 66 that deposits cyan toner 68 onto the image area. At this time four colors of toner are on the image area, resulting in a composite color image. However, the composite color toner image is comprised of individual toner particles that have charge potentials that vary widely. Directly transferring such a composite toner image onto a substrate would result in a degraded final image. Therefore it is beneficial to prepare the composite color toner image for transfer.

To prepare for transfer a pretransfer erase lamp 72 discharges the image area to produce a relatively low charge level on the image area. The image area then passes a pretransfer DC scorotron 80 that performs a pre-transfer charging function. The image area continues to advance in the direction 12 past the driven roller 14. A substrate 82 is then placed over the image area using a sheet feeder (which is not shown). As the image area and substrate continue their travel they pass a transfer corotron 84 that applies positive ions onto the back of the substrate 82. Those ions attract the negatively charged toner particles onto the substrate. As the substrate continues its travel is passes a detack corotron 86. That corotron neutralizes some of the charge on the substrate to assist separation of the substrate from the photoreceptor 10. As the lip of the substrate 82 moves around the tension roller 18 the lip separates from the photoreceptor.

The substrate is then directed into a fuser 90 where a heated fuser roller, a fuser belt, and a pressure roller create a nip through which the substrate 82 passes. The combination of pressure and heat at the nip causes the composite color toner image to fuse into the substrate. After fusing, a chute, not shown, guides the substrate to a catch tray, also not shown, for removal by an operator. As the principles of the present invention operation are closely related to the fuser 90, that fuser and its fuser belt are described in more detail below.

After the substrate 82 separates from the photoreceptor belt 10 the image area continues its travel and passes a preclean erase lamp 98. That lamp neutralizes most of the charge remaining on the photoreceptor belt. After passing the preclean erase lamp the residual toner and/or debris on the photoreceptor is removed at a cleaning station 99. The image area then passes once again to the precharge erase lamp 21 and the start of another printing cycle.

In addition to the elements described above, the printer 8 also includes a system controller 101 (shown in four places in FIG. 1) that controls the overall operation of the printer and that applies video information to the exposure stations.

Figure 2:
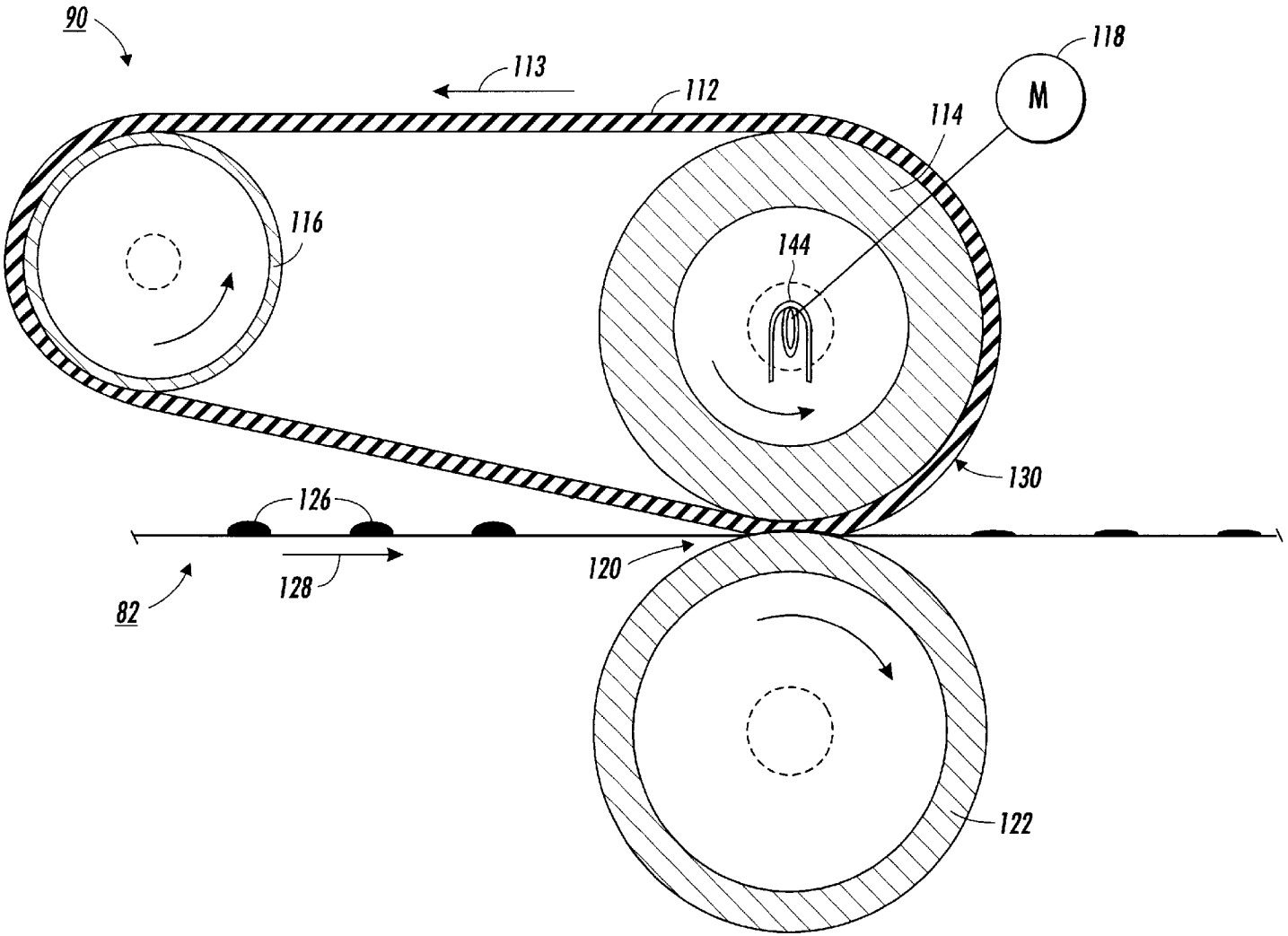
FIG. 2 illustrates the fuser used in the printing machine of FIG. 1.

FIG. 2 illustrates the fuser 90 in more detail. The fuser includes a slightly stretchable, double layer fuser belt 112 that is supported along its circumference by a driven roller 114 and by an idler roller 116. The driven roller 114 is rotated by a motor 118 such that the fuser belt travels in the direction 113. As the fuser belt 112 passes around the driven roller 114 it forms a fusing nip 120 with a pressure roller 122. The substrate 82 with its toner 126 advances in the direction 128 through the fusing nip such that toner contacts an outer surface 130 of the belt 112. The fusing nip 120 beneficially comprises a single nip, in that, the section of the belt 112 that contacts the driven roller 114 is coextensive with the opposite side of the belt that contacts the pressure roller 122. A single nip insures a single nip velocity through the entire nip. As shown in FIG. 2 the driven roller 114 is heated by an internal quartz lamp 144. The driven roller is beneficially comprised of a highly thermal conductive material such as aluminum. Therefore, as the substrate 82 passes through the nip the toner is heated and pressed into the substrate, causing the toner to fuse with the substrate.

As previously mentioned the fuser belt 112 is a double layer belt. FIG. 3 illustrates a cut-away view of the fuser belt 112. As shown, the fuser belt includes an elastic layer 140 and a fabric layer 142. The elastic layer is preferably comprised of a silicone rubber, flouropolymer, or other material of the type that is conventionally utilized in fuser belts. As such, the elastic layer has a low surface tension such that the toner 126 (see FIG. 2) does not readily stick to the outer surface 130. Furthermore, the conformability of the elastic layer is such that under tension the elastic layer 140 will deform (stretch) slightly. The thickness of the elastic layer 140 is in the order of 0.006 to 0.125 inch.

FIG. 4 shows a schematic, top-down view of the fabric layer 142. The fabric layer 142 is comprised of high modulus, high temperature fibers fibers 146 and 148 that are woven at acute angles with the direction 113 of motion of the fuser belt. The fibers, fiber density, and weave angle are selected such that the fabric layer is slightly stretchable in the direction 113. A stretch of 1–10% in the direction 113 for a given fuser belt tension is usually adequate. Turning back to FIG. 3, the elastic layer 140 is bonded to the substrate layer 142 using a strong, heat-resistant glue. If the elastic layer is formed from a liquid elastomer, and if that liquid elastomer adequately soaks into the fabric matrix, glue may not be required. In any event embedding the elastomer that comprised the elastic layer into the fabric layer improves the adhesion of the composite belt. This enables the belt to be subjected to sharp directional changes without delaminating. In some applications the fabric layer can be made thermally, electrically or magnetically conductive to facilitate toner release or transfer.

The combination of the elastic layer and the fabric layer significantly changes the nip dynamics so as to improve toner release. In operation, as the fuser belt 112 advances around the idler roller 116 the fuser belt stretches slightly as the driven roller 114 pulls on the fuser belt. This stretch is a result of the stretchability of both the elastic layer 140 and the fabric layer 142. The result is a strain energy on the outer surface 130 of the fuser belt. After the fuser belt passes through the nip 120 the strained fabric layer 142 relaxes because the pull on the fuser belt is reduced. This shrinks the fuser belt, which decreases the adherence between the fused toner and the outer surface 130.

Figure 5:
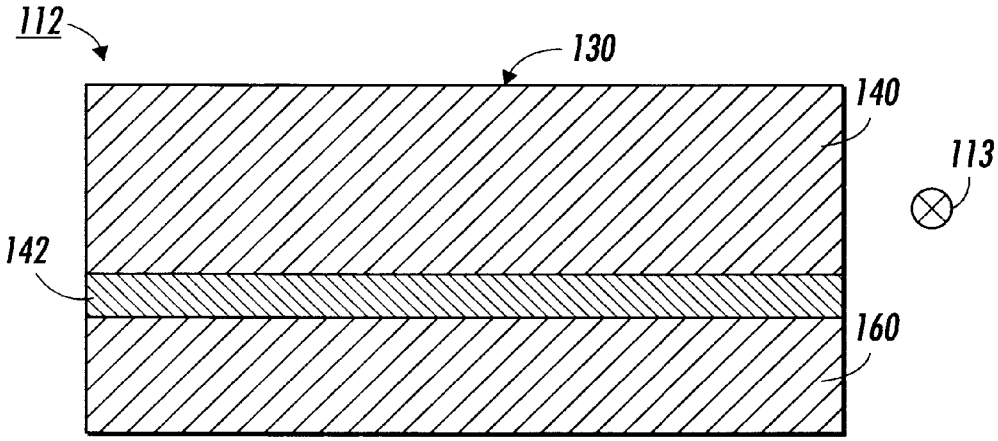
FIG. 5 illustrates a cutaway view of an alternative fuser belt having three layers.

While FIG. 3 illustrates a two layer belt, the principles of the present invention can be used with belts having more layers. For example, FIG. 5 illustrates a cut-away view of a three layer fuser belt 158. As shown, the fuser belt includes not only the elastic layer 140 and the rigid substrate layer 142, but also a lower elastic layer 160. Like the elastic layer 140, the lower elastic layer 160 is preferably comprised of an elastic material that will maintain its strength and life with repeated cycling at high temperatures. However, since the lower elastic layer 160 makes contact with a driven roller the lower elastic layer 160 should present a relatively high friction surface.

Figure 6:
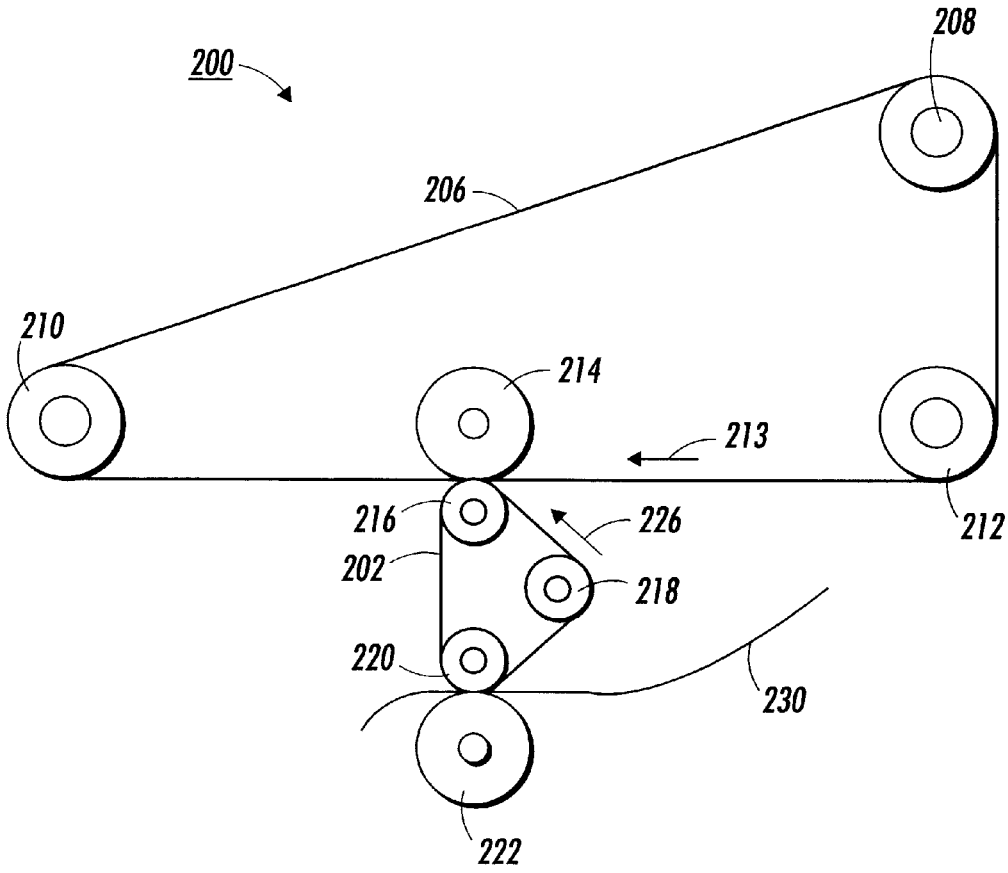
FIG. 6 illustrates a simplified schematic diagram of a printer having a transfix belt.

While the foregoing illustrates the present invention with one type of fuser belt, the principles of the present invention can find use with other types of fusing belts, such as transfix belts. With transfix belts toner on a photoreceptor is first transferred onto the transfix belt, a substrate is placed over the transferred toner, and then the transfix belt fuses the toner with the substrate. Turn now to FIG. 6 for a simplified schematic diagram of a printer 200 that uses a transfix belt 202. A photoreceptor 206 is held in position by a driven roller 208, idler rollers 210 and 212, and transfer roller 214. The photoreceptor is rotated in the direction 213 by the driven roller. The transfix belt 202 is held adjacent the transfer roller by idle roller 216 and 218, and a heated roller 220. Opposite the heated roller is a pressure roller 222. The transfix belt is driven by the motion of the photoreceptor in the direction 226. The toner image on the photoreceptor is transferred to the transfix belt when the toner image contacts the transfix belt (electrostatic forces produced by power supplies that are not shown may be used for transfer). The transferred image is subsequently transferred to a substrate 230 that is feed into the nip between the heated roller 220 and the pressure roller 222. As the substrate passes through the nip the toner is simultaneously transferred and fused to the substrate.

While not shown in the figures for clarity, it is common practice to apply a release fluid to the outer surface 130 of the fuser belt 112. This release fluid is usually applied by a release management system. Release fluids further reduce sticking.

It is to be understood that while the figures and the above description illustrate the present invention, they are exemplary only. Others who are skilled in the applicable arts will recognize numerous modifications and adaptations of the illustrated embodiment that will remain within the principles of the present invention. For example, it is possible to arrange the fuser components such that the fuser belt is pre-heated by the driven roller before the fuser belt enters the fuser nip. In addition, the belt materials can be selected to improve the operational characteristics of the belt. For example, in some applications the belt materials might be optimized to improve toner release or to assist in driving the belt. Therefore, the present invention is to be limited only by the appended claims.

What is claimed:

1. A multiple layer fuser belt having a circumferential surface substantially parallel to inner and outer surfaces of the belt, said fuser belt including a fabric layer having a first side and a second side and wherein said fabric layer is woven with fibers at acute angles with a circumference of the fuser belt in the circumferential surface of the fuser belt, the fibers also being parallel to the circumferential surface of the belt, said fuser belt further including an elastic layer over said first side, wherein said elastic layer is comprised of a conformable material having a low surface tension.

2. The fuser belt according to claim 1, wherein said elastic layer is made from a liquid elastomer, and wherein said liquid elastomer soaks into said fabric layer.

3. The fuser belt according to claim 1, wherein said fuser belt stretches easier in the direction of said circumference than in a direction perpendicular to said circumference.

4. The fuser belt according to claim 1, wherein said elastic layer is comprised of silicon.

5. The fuser belt according to claim 1, wherein said elastic layer is comprised of fluoropolymer.

6. The fuser belt according to claim 1, further including a third layer, wherein said third layer covers said second side of said fabric layer.

7. A fuser assembly comprised of:

a fuser roller;

a fuser belt at least partially wrapped around said fuser roller, said fuser belt including a fabric layer having a first side and a second side and wherein said fabric layer is woven with fibers at acute angles with a circumference of the fuser belt in a circumferential surface substantially parallel to inner and outer surfaces of the belt of the fuser belt, the fibers also being parallel to the circumferential surface of said fuser belt, said fuser belt further including an elastic layer over said first side, wherein said elastic layer is comprised of a conformable material having a low surface tension; and a pressure roller adjacent said fuser roller and forming a nip with said fuser belt.

8. A fuser assembly according to claim 7, wherein said elastic layer is made from a liquid elastomer, and wherein said liquid elastomer soaks into said fabric layer.

9. A fuser assembly according to claim 7, wherein said fuser belt stretches easier in the direction of said circumference than in a direction perpendicular to said circumference.

10. A fuser assembly according to claim 7 wherein said elastic layer is a silicon.

11. A fuser assembly according to claim 7 wherein said elastic layer is comprised of fluoropolymer.

12. A fuser assembly according to claim 7, wherein said fuser assembly is a transfix fuser assembly.

13. The fuser belt according to claim 7, further including a third layer, wherein said third layer covers said second side of said fabric layer.

14. An electrophotographic printing machine comprised of:

a photoreceptor having a photoconductive surface;

a charger for charging said photoconductive surface to a predetermined potential;

an exposure station for exposing the photoconductive surface to produce an electrostatic latent image on the photoconductive surface;

a developer for depositing a toner layer on the photoconductive surface;

a transfer station for transferring said toner layer onto a receiving substrate; and a fuser for fusing said toner layer with said receiving substrate, said fuser including a fuser roller;

a fuser belt over said fuser roller, said fuser belt including a fabric layer having a first side and a second side and wherein said fabric layer is woven with fibers at acute angles with a circumference of the fuser belt in a curcumferential surface of said fuser belt that is substantially parallel to inner and outer surfaces of the fuser belt, the fibers also being substantially parallel to an outer surface of said fuser belt, said fuser belt further including an elastic layer over said first side, wherein said elastic layer is comprised of a conformable material having a low surface tension; and a pressure roller adjacent said fuser roller for forming a nip with said fuser belt.

15. An electrophotographic printing machine according to claim 14, wherein said elastic layer is made from a liquid elastomer, and wherein said liquid elastomer soaks into said fabric layer.

16. An electrophotographic printing machine according to claim 14, wherein said fuser belt stretches easier in the direction of said circumference than in a direction perpendicular to said circumference.

17. An electrophotographic printing machine according to claim 14, wherein said elastic layer is comprised of silicon.

18. An electrophotographic printing machine according to claim 14, wherein said elastic layer is comprised of fluoroplymer.

19. An electrophotographic printing machine according to claim 14, wherein said fuser is a transfix fuser.

20. An electrophotographic printing machine according to claim 14, further including a third layer, wherein said third layer covers said second side of said fabric layer.

* * * * *